US010208439B2

(12) United States Patent
Sill et al.

(10) Patent No.: US 10,208,439 B2
(45) Date of Patent: Feb. 19, 2019

(54) PAVEMENT MARKING TAPE WITH WIDELY-DISTRIBUTED, MULTI-EDGED RELIEF FEATURES FOR IMPROVED RETROREFLECTIVITY

(71) Applicant: Brite-Line Technologies, LLC, Canton, MA (US)

(72) Inventors: Gordon Sill, Monument, CO (US); Kevin H. White, Denver, CO (US); Robert Humphrey, Boulder, CO (US); Michael Pitt, Arvada, CO (US); Coit Stevenson, Denver, CO (US); Wil McCarthy, Lakewood, CO (US)

(73) Assignee: BRITE-LINE TECHNOLOGIES, LLC, Canton, MA (US)

( * ) Notice: Subject to any disclaimer, the term of this patent is extended or adjusted under 35 U.S.C. 154(b) by 176 days.

(21) Appl. No.: 14/826,998

(22) Filed: Aug. 14, 2015

(65) Prior Publication Data

US 2016/0047093 A1 Feb. 18, 2016

Related U.S. Application Data

(60) Provisional application No. 62/037,293, filed on Aug. 14, 2014.

(51) Int. Cl.
*E01F 9/576* (2016.01)
*E01F 9/506* (2016.01)

(52) U.S. Cl.
CPC ..... *E01F 9/578* (2016.02); *E01F 9/506* (2016.02); *E01C 2201/00* (2013.01)

(58) Field of Classification Search
CPC ..... E01F 9/083; E01F 9/578; E01F 9/506; E01C 2201/00
USPC ..... 116/63 R, 200–201, 205, 209, 278; 404/6, 9, 12–14; 52/33, 38, 174, 177; 40/582, 612; 362/152–153, 153.1; 340/332, 815.4, 944; 434/75
See application file for complete search history.

(56) References Cited

U.S. PATENT DOCUMENTS

D93,992 S * 12/1934 Moore ..... D25/158
2,127,233 A * 8/1938 Older ..... E01F 9/578 404/12
3,200,243 A * 8/1965 McDevitt ..... B64F 1/20 362/153
3,343,467 A * 9/1967 Bonvallet ..... E01F 9/553 404/16
3,418,896 A * 12/1968 Rideout ..... B29D 11/00615 359/540
3,453,660 A * 7/1969 Daigle ..... B65C 11/004 156/378
3,877,786 A 4/1975 Booras et al.
4,040,760 A * 8/1977 Wyckoff ..... E01F 9/524 359/551

(Continued)

*Primary Examiner* — R. A. Smith
*Assistant Examiner* — Tania Courson
(74) *Attorney, Agent, or Firm* — Dorsey & Whitney LLP

(57) ABSTRACT

A pavement marking tape has raised, irregular polygonal relief features with retroreflective elements covering a portion of the surface of the tape. The form of the relief features minimizes shadowing effects. Raised relief features are shaped to increase the visible number of vertical faces and edges of the relief features, which are the most reflective structures, and are oriented toward incident light from an approaching observer to maximize retroreflectivity.

18 Claims, 3 Drawing Sheets

(56) References Cited

U.S. PATENT DOCUMENTS 4,129,397 A * 12/1978 Eigenmann ..... E01F 9/578 404/14
4,145,112 A * 3/1979 Crone ..... E01F 9/512 359/531
4,236,788 A * 12/1980 Wyckoff ..... G02B 5/128 359/551
4,401,050 A * 8/1983 Britt ..... A62B 3/00 116/205
4,570,207 A * 2/1986 Takahashi ..... E01F 9/582 340/944
4,620,816 A * 11/1986 Kupfer ..... A61H 3/066 404/6
4,818,138 A * 4/1989 Brown ..... E01F 9/553 116/63 R
4,969,713 A * 11/1990 Wyckoff ..... E01F 9/512 359/538
4,988,541 A 1/1991 Hedblom
5,108,218 A * 4/1992 Wyckoff ..... E01F 9/578 404/11
5,310,278 A * 5/1994 Kaczmarczik ..... E01F 9/578 362/153.1
5,453,320 A * 9/1995 Harper ..... B32B 25/04 428/356
5,516,227 A * 5/1996 Kozak ..... C09D 5/004 106/436
5,557,461 A 9/1996 Wyckoff
5,670,227 A 9/1997 Hedblom et al.
5,683,746 A * 11/1997 Hedblom ..... G02B 5/128 404/14
5,777,791 A * 7/1998 Hedblom ..... E01F 9/524 359/536
5,853,846 A * 12/1998 Clark ..... B32B 5/16 428/131
5,941,655 A * 8/1999 Jacobs ..... E01F 9/524 116/63 R
5,975,706 A * 11/1999 Nakayama ..... E01F 9/669 359/529
6,025,773 A * 2/2000 Bresnan ..... G08B 6/00 116/205
6,237,266 B1 * 5/2001 Tassey ..... G08B 7/066 362/153
6,328,500 B1 * 12/2001 Rubio ..... A63C 19/00 104/55
6,412,957 B1 * 7/2002 Oba ..... E01F 9/512 359/536
6,431,788 B1 * 8/2002 Hedblom ..... E01F 9/512 404/12
6,479,132 B2 * 11/2002 Hedblom ..... E01F 9/524 359/536
6,499,421 B1 * 12/2002 Honigsbaum ..... G09F 19/22 116/205
7,168,815 B2 * 1/2007 Shipman ..... B29D 11/00605 359/530
7,182,040 B2 * 2/2007 Pharo ..... G07C 11/00 116/200
8,425,144 B2 * 4/2013 Bjorklund ..... E01C 23/166 404/14
2001/0046413 A1 * 11/2001 Moorhead ..... E01F 9/559 404/1
2001/0048847 A1 * 12/2001 Khieu ..... E01F 9/553 404/16
2002/0066400 A1 * 6/2002 Pharo ..... G07C 11/00 116/278
2002/0121985 A1 * 9/2002 Blum ..... A47L 23/22 340/815.4
2003/0091815 A1 * 5/2003 Buccellato ..... C09J 4/00 428/343
2003/0123931 A1 * 7/2003 Khieu ..... E01F 9/512 404/12
2012/0037025 A1 * 2/2012 Patel ..... B32B 27/08 101/483
2014/0144370 A1 * 5/2014 Lee ..... E01F 9/553 116/63 R
2016/0209559 A1 * 7/2016 McCarthy ..... G02B 5/128

* cited by examiner

PAVEMENT MARKING TAPE WITH WIDELY-DISTRIBUTED, MULTI-EDGED RELIEF FEATURES FOR IMPROVED RETROREFLECTIVITY

BACKGROUND

1. Technical Field

The subject matter described herein relates to a type of retroreflective pavement marking tape with spread-out features designed to improve retroreflectivity and decrease cost.

2. Description of the Related Art

The idea of marking pavement using retroreflective tapes (whether durable/permanent or removable) has a long history, dating back to at least the mid-1970s when multilayered, retroreflective laminate materials intended to be used for road and highway marking, among other applications, were developed. Although they may have incorporated some crowning (i.e., thicker in the middle than along the edges), these tapes were generally flat. However, in the early 1990s a series of pavement marking tapes were developed that had raised, regularly spaced, square-shaped embossed features intended to improve retroreflectivity by placing the reflective elements (generally, microscopic glass beads) on the vertical faces of the raised square bosses or bumps, rather than on a uniform horizontal surface. Generally speaking, this tactic is extremely effective, although such tapes are somewhat more difficult to manufacture.

The raised features also improve drainage during rain, and delay the moment when the tape is completely covered under conditions of snow or minor flooding. Furthermore, because the retroreflective elements are on the vertical rather than the horizontal faces, they are somewhat better protected from mechanical abuse due to tire hits and snow plows. However, these are not thought to be primary motivations for the development of these embossed tapes.

During the 1990s it was noticed that with this plurality of regularly spaced and closely packed features, there is a shadowing or interference effect wherein each raised bump blocks the view of the ones behind it. Thus, for any given viewing angle some bumps are "wasted" in the sense that they do not contribute to overall reflectivity, and can even detract from it. New relief patterns were therefore developed in which the raised squares were more widely distributed and also less regularly distributed, and covered between 15% and 45% of the total surface. This change reduces the shadowing effect, improving retroreflectivity while simultaneously requiring less material (rubber matrix, pigment, polymer topcoat, glass beads, etc.) to manufacture. Such tapes represent the current state of the art.

The information included in this Background section of the specification, including any references cited herein and any description or discussion thereof, is included for technical reference purposes only and is not to be regarded as subject matter by which the scope of the claimed invention is to be bound.

SUMMARY

The technology disclosed herein is similar to known pavement marking tapes in that it includes raised relief features (e.g., bumps or bosses) that may cover approximately 20% of the total surface. However, in the present disclosure both the shape and the distribution of the raised relief features are different, such that retroreflectivity is higher. In one exemplary implementation, the raised relief features are shaped (from a top plan view) like irregular hexagons that are compressed or "foreshortened" in one dimension, thus having a long axis and a short axis. This shape provides more frontal area to the retroreflectors and more vertical edge length oriented in the prevailing direction of incident light for a given amount of material, both of which are important to retroreflectivity for reasons which will be discussed below.

In addition, in implementations disclosed herein, the orientation of the relief features is varied (i.e., the relief features are presented with non-uniform orientation) and the relief features are spaced or distributed further apart than in prior art designs, which for most polygon shapes (whether regular or irregular) has a dramatic effect on retroreflectivity as observed by approaching motorists.

The structures and methods disclosed herein have particular, but not exclusive, application for pavement marking tapes, and may also be used to mark such features as telephone poles, speed bumps, parking barriers, and other objects which might plausibly be illuminated by artificial spotlights (e.g., headlights) and for which enhanced nighttime visibility presents an aesthetic, communicative, directional, or safety advantage.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various examples of the invention and illustrated in the accompanying drawings.

DETAILED DESCRIPTION

Typically, road or pavement marking tape is made from a resilient rubber or polymeric base sheet that includes pigment (e.g., titanium dioxide to provide a white diffuse surface and yellow ochre to impart a yellow color). A pattern of protrusions, bosses, or other relief features are formed in the top surface of the pavement marking tape. Retroreflective beads or other particles are bonded to all or portions of the top surface including the bosses with an adhesive. Such retroreflective elements are provided to reflect light back to its source (e.g., headlights on a vehicle) with a minimum of scattering. Retroreflective beads suitable for use are typically glass beads formed of glass materials having indices of refraction (n) from about 1.5 to about 1.9, although beads having higher indices of refraction may be used. The glass beads may include a silver or other specular reflective metallic or dielectric coating on the portion of the beads embedded in the adhesive. Additionally, other useful particles, such as skid-preventing particles, may be bonded to the top surface of the bosses. An adhesive layer is further provided to the bottom surface of the tape for adhesion to the pavement or other surface for application. Many different polymers, adhesives, and retroreflectors used in the manufacture of pavement marking tape, and methods of manufacture themselves, are well known in the art and are not described in detail here in order to focus on the primary aspects of this disclosure.

Figure 1:
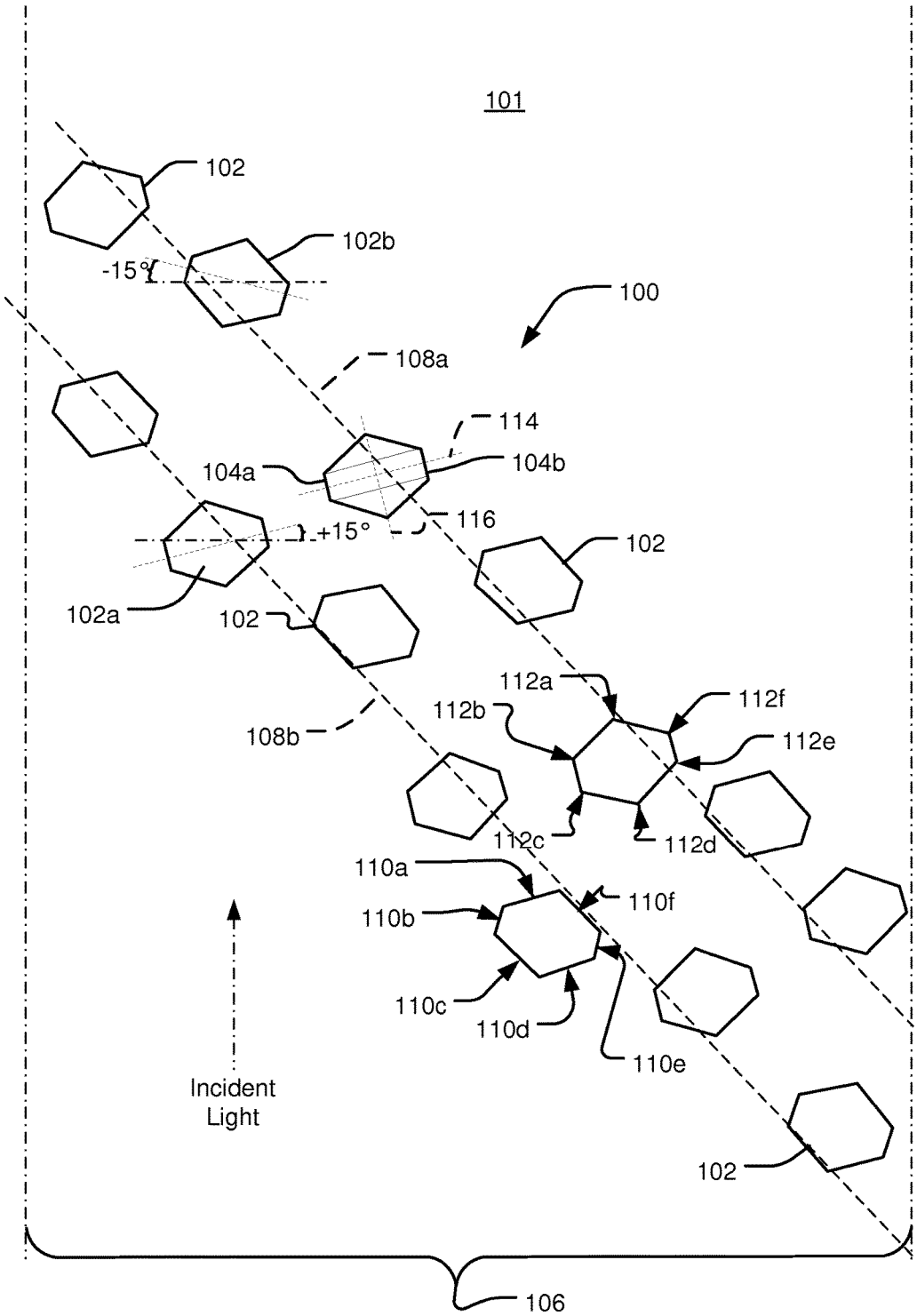
FIG. 1 is a schematic drawing of an exemplary implementation showing an exemplary pattern of relief features on pavement marking tape.

FIG. 1 is a schematic drawing showing an exemplary pattern 100 of relief features 102 on a width 106 of pavement marking tape 101. The relief features 102 are formed as irregular hexagons that are compressed or "foreshortened" in one dimension, thus having a long axis and a short axis. In the exemplary embodiment the relief features 102 may have a thickness equal to or less than the thickness of the rubber or polymer substrate 105 (see FIGS. 2, 3A, and 3B) from which they extend and cover between 10% and 50% of the upper surface of substrate 105. In the example shown, two opposing sides 104*a,b* of the hexagon are shortened. The relief features 102 are thus wider along a long axis 114 that is perpendicular to the shortened sides 104*a,b* than along a short axis 116 that is parallel to the shortened sides 104*a,b*. In other words, two opposing shortened sides 104*a,b* are shorter than the remaining four adjacent sides to the two opposing shortened sides 104*a,b* and are substantially parallel to a longitudinal length of the pavement marking tape 101. This results in a wider profile for the relief features 102 (as seen by an oncoming vehicle) than a square- or diamond-shaped bump using the same amount of material. In FIG. 1, the raised relief features (102) have six substantially vertical faces 110*a,b,c,d,e,f* and six vertical linear edges 112*a,b,c,d,e,f*. Thus, instead of being exposed to either 1 or 2 vertical faces and 2 or 3 vertical edges per bump with a square or diamond shape, a viewer in an oncoming vehicle sees at least 2 vertical faces and 3 linear edges and often 3 vertical faces and 4 vertical linear edges. These 3 vertical faces and 4 vertical linear edges receive incident light from traveling vehicles that is substantially parallel to a longitudinal length direction of the pavement marking tape. The opportunities for retroreflectivity are thereby increased, and the roadway marking becomes more visible for a similar amount of material.

As can be seen in FIG. 1, the pattern for this preferred example consists of irregular compressed hexagons arranged around respective parallel lines 108*a,b*, with 7 relief features 102 per line across the width of the tape. The positioning of the relief features 102 with respect to the lines 108*a,b* is arbitrary in this example, and can be modified as desired. Additionally, alternative examples may include different angles of parallel lines, different numbers of relief features per line, different sizes of relief features, and different width-to-length ratios for the relief features.

The relief features 102 are formed as irregular compressed hexagons, i.e., the hexagons are compressed or "foreshortened" along one axis of symmetry while the other axes of symmetry are maintained, when considered from a top plan view. The irregular compressed hexagons have a long axis 114 oriented at ±15° to the perpendicular of the direction of vehicle travel, i.e., ±15° to the perpendicular of the longitudinal direction (i.e., length) of the tape 101. The shortened sides 104*a,b* are thus ±15° to the parallel of the longitudinal direction (i.e., length) of the tape 101, which is considered herein to be "substantially parallel". This angular value has proven superior in terms of reflectivity to ±0°, ±30°, and ±45°, although these and other values may be used in other examples. In this depicted example, the orientations of the hexagons alternate between positive 102*a* and negative 102*b* from the perpendicular, although this is not a mandatory feature, and other orientation sequences may be used instead. The pattern of this example, and others like it, when repeated, give a pseudo-random appearance and excellent retroreflectivity, both at the time of manufacture, at installation, and at important measurement milestones (e.g., 100,000 tire hits for removable tape, or 1,000,000 tire hits for durable tape).

Figure 2:
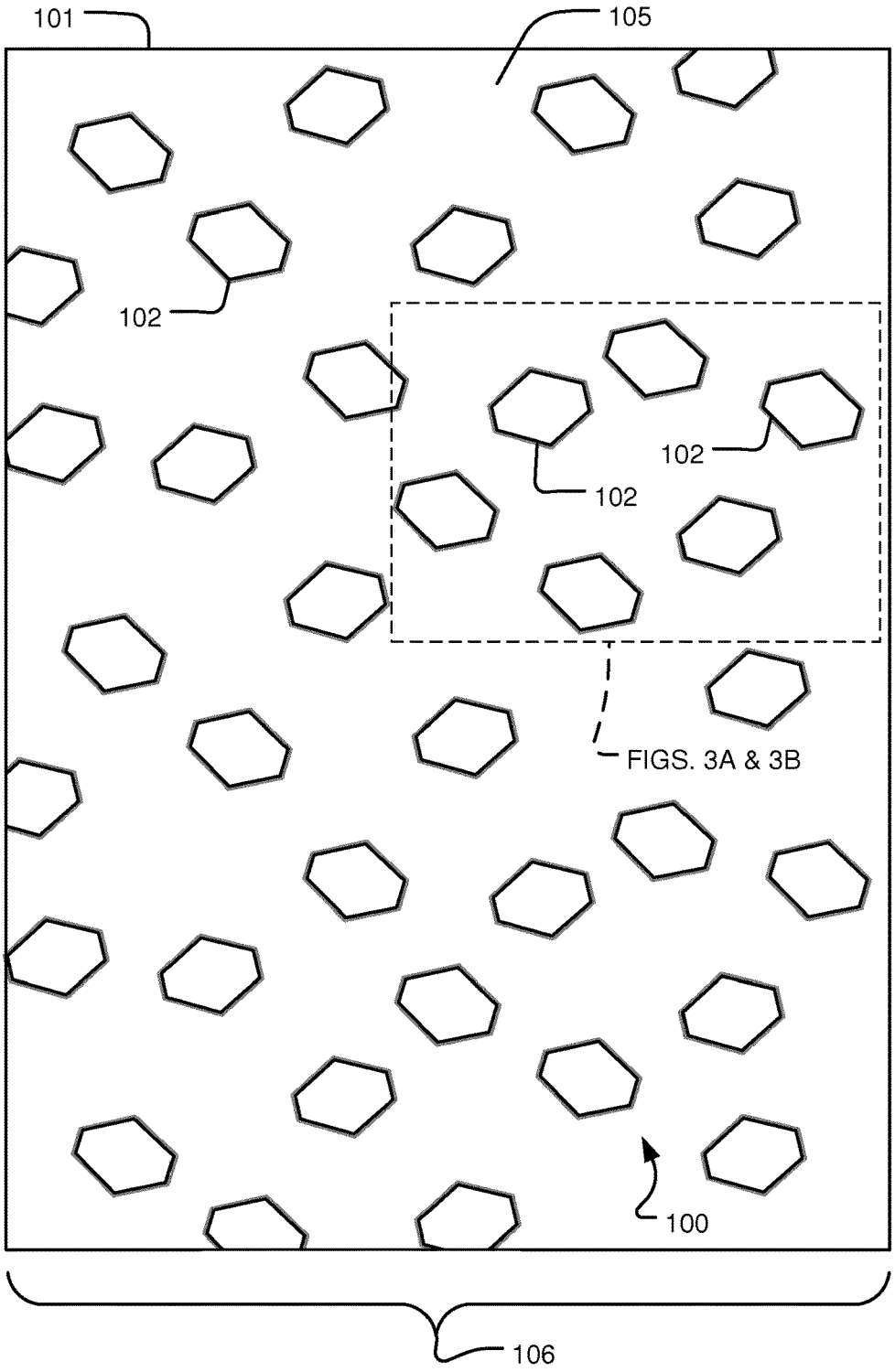
FIG. 2 is a schematic drawing of an exemplary relief pattern formed across an entire section of pavement marking tape.

FIG. 2 is a schematic diagram from a top plan view of the irregular, compressed hexagon relief pattern 100 formed across an entire section of tape 101, and shows how the pattern 100, although deterministic and rationally designed, gives a pseudo-random appearance. As seen in FIG. 2, the irregular compressed hexagon relief pattern 100 may have relief features 102 irregularly or variably offset from the respective parallel lines 108*a,b*. From most plausible service viewing angles, this limited but significant variation in the position and orientation of the raised relief features results in dramatically improved retroreflectivity as compared to a regular pattern of features all with the same orientation. Shadowing effects are minimized and, for each raised feature, an oncoming vehicle driver will see 2-3 vertical faces and 3-4 vertical edges (vs. 1-2 vertical faces and 2-3 vertical edges for a square pattern), affording many opportunities for reflection.

Figure 3A:
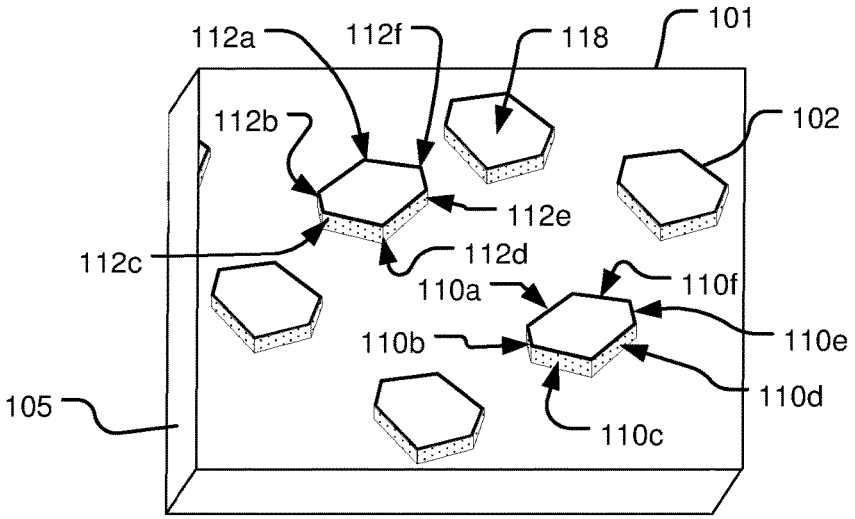
FIG. 3A is a schematic diagram from a top isometric vantage of the area indicated in FIG. 2 showing the profile faces of the relief features.
Figure 3B:
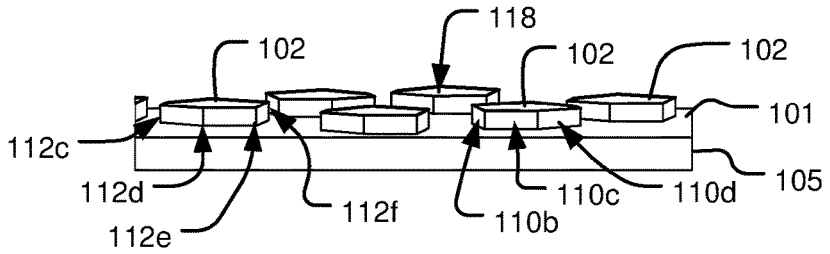
FIG. 3B is a schematic diagram from a front isometric vantage of the area indicated in FIG. 2 showing the profile faces of the relief features.

FIG. 3A depicts a portion of the tape 101 indicated in FIG. 2 from a top perspective view to better show the vertical faces 110*a,b,c,d,e,f* and linear edges 112*a,b,c,d,e,f* of each of the relief features 102. FIG. 3B depicts the portion of the tape 101 indicated in FIG. 2 from a front perspective view. In this view it is apparent that for each relief feature 102, there is a strong possibility that three vertical faces 110*b/c/d* (in the exemplary relief feature so labeled) and four vertical linear edges 112*c/d/e/f* (in the exemplary relief feature so labeled) will receive incident light from a light source substantially parallel to the length of the tape 101.

Figure 4:
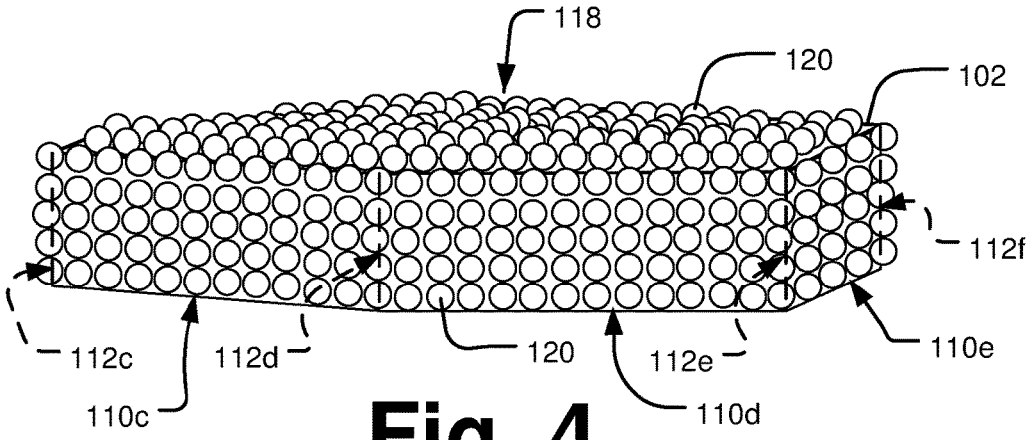
FIG. 4 is a schematic diagram of an individual relief feature coated with retroreflective beads and exposing four vertical edges.

FIG. 4 depicts a single exemplary relief feature 102 in isolation. In this schematic presentation, three vertical faces 110*c/d/e* and four vertical linear edges 112*c/d/e/f* are oriented to receive incident light. As depicted, the entire relief feature is coated with retroreflective elements, e.g., retroreflective particles or beads 120, including a top surface 118 and all the vertical faces. The retroreflective beads 120 are substantially smaller than the relief feature 102 and are adhered to or embedded within, or both, the relief feature 120. In some examples, an adhesive may be applied to the relief features 102 and then the retroreflective beads 120 may be coated on top of the adhesive. In some examples, the adhesive may contain a pigment, which may be the same pigment (or color) as in the substrate, or it may be a different pigment (and color) than in the substrate to provide multiple colors to the pavement marking tape 101. In other examples, retroreflective beads 120 may be deposited on the relief features 102 and then coated with an adhesive to secure the retroreflective beads 120 to the relief features 102.

In some examples the placement of retroreflective beads may be limited to the vertical faces, especially those in the view of an oncoming vehicle, to reduce cost and to maximize the useful retroreflectivity that can be achieved for a given quantity of beads (e.g., in g/ft$^2$). However, the total initial retroreflectivity is maximized when the same spatial density of retroreflective beads 120 is applied to the horizontal top surface 118 as well as the vertical faces 110*a,b,*

*c,d,e,fc,d,e,f* as shown in FIG. 4. This requires use of a larger quantity of beads (e.g., in g/ft$^2$), but results in a higher quality product with regard to initial reflectivity.

By making the relief features 102 irregular compressed hexagons rather than squares, diamonds, or rectangles the designs disclosed herein accomplish several things. First, the frontal area of each relief feature 102 as seen from the viewpoint of an approaching motorist is maximized when the tape 101 is applied to a road surface in the intended manner and orientation. While the profile of a square-shaped or diamond-shaped embossed feature will present either 1 or 2 vertical faces to an approaching observer, a hexagonal-shaped relief feature will present either 2 or 3 vertical faces (depending upon angle of orientation and direction of incident light. Since the vertical faces 110*a,b,c,d,e,f,* of the relief features provide higher retroreflectivity than the horizontal top 118, the result is higher overall reflectivity for the tape 101.

In addition, it has been observed that retroreflectivity is particularly concentrated along the vertical linear edges 112*a,b,c,d,e,f,* that join the vertical faces 110*a,b,c,d,e,f,* theoretically because the retroreflective beads 120 are less obstructed there and can capture and return light from a greater range of incident angles. While the profile of a square-shaped or diamond-shaped feature will present either 2 or 3 vertical linear edges to an approaching observer, a hexagonal shape may present either 3 or 4 vertical linear edges. Once again, this results in higher overall retroreflectivity for the tape 101.

The distribution of the relief features is also important, both to minimize shadowing and to maximize the number of vertical edges and faces visible to an observer at any given range and incident angle. Thus, while the arrangement of features is ultimately a repeating pattern (as it must be, for fabrication using standard calendering equipment), this is not immediately evident, and indeed the pattern may appear random at first glance, in terms of both the positioning and orientation of the raised features.

Although the figures represent only particular exemplary examples, it is intended that the pattern shown is exemplary rather than limiting. For example, the specific number, density, arrangement, orientation, and shape of the raised relief features 102 could be different than shown herein without departing from the scope of the invention as claimed. In fact, the shapes could be irregular or regular variations of hexagons, heptagons, or octagons. However, it is submitted that circular relief patterns are disadvantageous because they have, in essence, only one vertical face, and completely lack the vertical edges which are observed to concentrate retroreflectivity. Therefore, it is also submitted that polygonal features with large numbers of sides (i.e., more than eight) are too "circle-like" and are therefore less effective than hexagons, heptagons, or octagons. Additionally, squares or diamonds (and some orientations of pentagons) do not have enough faces or edges to present more than two faces and three edges toward incident light. Among the potential options, it is believed that hexagons, and in particular irregular compressed hexagons as described herein, that present their broadest profile approximately perpendicular to the direction of vehicle travel, are ideal forms for the relief features.

Other variations are also possible. For example, the pavement marking tape could be a permanent tape intended to remain in place for many years after installation on a pavement surface. Alternatively, the pavement marking tape could be a temporary tape intended to be removed after a period of a few months or even a few days, as with the markings for a construction zone or special event. The difference between a temporary (or removable) and a permanent (or durable) tape is generally defined by the peel strength of its adhesive and the flowability/conformability of its rubber matrix, but could also be defined, for example, by the weave dimensions of an attached fabric "scrim" that sits between the rubber and the adhesive, or by the chemical or mechanical properties of a "primer" compound applied to the pavement prior to the application of the tape, or by the specific properties of a particular paving surface (e.g., a polished concrete floor of a garage as opposed to asphalt), or by the tear strength of the pavement marking tape (e.g., higher for a removable tape).

In addition, it should be understood that the pavement marking tape may be bonded to asphalt pavement of various grades and consistencies, or it could be bonded to concrete of various types and including mixes having various additives and fillers. In addition, the pavement marking tape may be applied to non-pavement surfaces such as walls, doors, floors, other building surfaces, signage, parking barriers, traffic barriers, utility poles, and even vehicles. As such, the pavement marking tape may be bonded to a vast assortment of other materials to provide a high degree of retroreflectivity.

Furthermore, while the width of a traditional highway tape is typically about 4" (10 cm), the retroreflective tape disclosed herein may be produced in any width, for example, to be used in crosswalk features or to mark words, symbols, or directional arrows on the pavement, or for other reasons presently anticipated or otherwise. Similarly, while the thickness of pavement marking tapes is typically between 40 and 80 mils (1.0-2.0 mm), the pavement marking tape as disclosed herein may be produced in any thickness as dictated by the needs of cost, manufacturing, installation, removal, and the particularities of the environment of intended use.

Still other variations are possible. The mixture bonded to the surface of the pavement marking tape may include traction-improving grit as well as retroreflective beads and pigment. The pavement marking tape may further include a "slip" coating to help end users unwind it from the roll, and/or an environmental overcoat to help keep the beads in place when tire hits and other environmental insults occur, or to improve the protection against rain, humidity, UV, cold, or heat. The pavement marking tape may also include a metal foil layer to enhance reflectivity, or a paper layer to allow the pavement marking tape to be removed from the pavement surface with a torch. The pavement marking tape may be white or yellow (the most common pavement marking colors), but may also be black, red, blue, purple, orange, or any other desired color. The pavement marking tape may be striped or otherwise multicolored, and may include text, symbols, or other markings. The pavement marking tape may be placed on the pavement manually, or with a hand-pushed automatic cart, or by a specialized applicator vehicle. The pavement marking tape may be manufactured, shipped, or sold in jumbo rolls of 1000 m or more, or in smaller rolls, or it may be available in sheet or strip form. In one example, the raised relief features may cover 20% of the surface of the tape. However, the raised relief features may cover at least 10% of the surface of the tape and as much as 50% of the surface of the tape. A person having ordinary skill in the art would recognize that the desired coverage percentage may depend on where and how the tape is cut by the end user.

In this document, all directional references e.g., proximal, distal, upper, lower, inner, outer, upward, downward, left, right, lateral, front, back, top, bottom, above, below, vertical, horizontal, clockwise, and counterclockwise are only used for identification purposes to aid the reader's understanding of the present invention as claimed, and do not create limitations, particularly as to the position, orientation, or use of the invention. Connection references, e.g., attached, coupled, connected, and joined are to be construed broadly and may include intermediate members between a collection of elements and relative movement between elements unless otherwise indicated. As such, connection references do not necessarily imply that two elements are directly connected and in fixed relation to each other. Stated values shall be interpreted as illustrative only and shall not be taken to be limiting.

The above specification, examples and data provide a complete description of the structure and use of exemplary examples of the invention as defined in the claims. Although various examples of the claimed invention have been described above with a certain degree of particularity, or with reference to one or more individual examples, those skilled in the art could make numerous alterations to the disclosed examples without departing from the spirit or scope of the claimed invention. Other examples are therefore contemplated. It is intended that all matter contained in the above description and shown in the accompanying drawings shall be interpreted as illustrative only of particular examples and not limiting. Changes in detail or structure may be made without departing from the basic elements of the invention as defined in the following claims.

What is claimed is:

1. A pavement marking tape, comprising a flat tape formed of a conformable rubber or polymer substrate with a first adhesive coated on an underside configured to adhere to a paved surface;

a plurality of raised relief features formed on an upper surface of the flat tape covering between 10% and 50% of the upper surface of the flat tape, wherein the plurality of raised relief features are formed as compressed irregular polygons having sides formed of five to eight vertical faces and five to eight vertical edges, two of the sides oppose each other, are substantially parallel to each other, and are shorter in length than adjacent sides extending between such two shortened opposing sides, the raised relief features are arranged such that an axis of each of the compressed irregular polygons perpendicular to the two shortened opposing sides is oriented ±15° to a perpendicular of a longitudinal length direction of the flat tape, and subsets of the plurality of raised relief features are arranged irregularly along respective, substantially parallel rows configured to reduce shadowing effects and maximize exposure of the plurality of raised relief features to incident light from vehicles; and a plurality of retroreflective elements attached to each of the vertical faces of the raised relief features, wherein the plurality of retroreflective elements are substantially smaller than the raised relief features.

2. The pavement marking tape of claim 1, wherein the raised relief features are shaped as compressed hexagons with the two shortened opposing sides separated from each other by respective sets of two longer sides between respective pairs of vertical edges defining each of the two shortened opposing sides.

3. The pavement marking tape of claim 2, wherein the shortened opposing sides of the compressed hexagons are arranged substantially parallel to a longitudinal length of the pavement marking tape.

4. The pavement marking tape of claim 2, wherein the compressed hexagons are arranged such that at least three of the vertical faces and at least four of the vertical edges receive incident light parallel to a longitudinal length direction of the flat tape.

5. The pavement marking tape of claim 1, wherein the raised relief features are arranged in a repeating pattern in sections along the longitudinal length direction of the flat tape when the flat tape is longer than a pattern length of a single section.

6. The pavement marking tape of claim 5, wherein the repeating pattern has a pseudo-random appearance.

7. The pavement marking tape of claim 1, wherein each interior angle between each adjacent pair of sides of the irregular polygons is obtuse.

8. The pavement marking tape of claim 7, wherein the raised relief features cover approximately 20% of the upper side of the flat tape.

9. The pavement marking tape of claim 1, wherein the plurality of substantially parallel rows of the subsets of the relief features are arranged at an angle of substantially 45 degrees to a longitudinal length direction of the flat tape.

10. The pavement marking tape of claim 1, wherein the retroreflective features are attached to a top face of the raised relief features.

11. The pavement marking tape of claim 1, wherein the retroreflective elements are embedded within a surface of the raised relief features.

12. The pavement marking tape of claim 1, wherein the retroreflective elements are adhered to the raised relief features with a second adhesive.

13. The pavement marking tape of claim 12, wherein the retroreflective elements are embedded in the second adhesive.

14. The pavement marking tape of claim 12, wherein the second adhesive includes a pigment.

15. The pavement marking tape of claim 14, wherein the substrate forming the flat tape further includes a different pigment than the pigment in the second adhesive.

16. The pavement marking tape of claim 1, wherein the substrate forming the flat tape further includes a pigment.

17. The pavement marking tape of claim 1, wherein the regular or irregular polygons are arranged such that at least three of the vertical faces and at least four of the vertical edges receive incident light parallel to a longitudinal length direction of the pavement marking tape.

18. The pavement marking tape of claim 1, wherein the raised relief features in the subsets are individually and variably offset from a straight line fitted to each respective subset row of the parallel rows to create a pseudo-random appearance.

* * * * *